United States Patent [19]

Yamamoto et al.

[11] Patent Number: 4,809,038

[45] Date of Patent: Feb. 28, 1989

[54] COLOR ELECTROPHOTOGRAPHIC APPARATUS AND METHOD

[75] Inventors: Hajime Yamamoto, Ibaraki; Yuji Takashima, Nishinomiya, both of Japan

[73] Assignee: Matsushita Electric Industrial Co., Ltd., Kadoma, Japan

[21] Appl. No.: 910,985

[22] Filed: Sep. 24, 1986

[30] Foreign Application Priority Data

Sep. 26, 1985 [JP] Japan ..... 60-212926
Sep. 26, 1985 [JP] Japan ..... 60-212927
Oct. 31, 1985 [JP] Japan ..... 60-244482

[51] Int. Cl.[4] ..... G03G 15/01

[52] U.S. Cl. ..... 355/4; 118/645; 346/157; 430/42

[58] Field of Search ..... 355/3 DD, 4; 346/157; 118/645, 648, 651, 657, 658; 430/42

[56] References Cited

U.S. PATENT DOCUMENTS 4,264,185 4/1981 Ohta ..... 355/4
4,308,821 1/1982 Matsumoto et al. ..... 355/4 X
4,351,604 9/1982 Karasawa et al. ..... 355/4
4,416,533 11/1983 Tokunaga et al. ..... 355/4

FOREIGN PATENT DOCUMENTS 60-95456 5/1985 Japan .

*Primary Examiner*—Fred L. Braun
*Attorney, Agent, or Firm*—Cushman, Darby & Cushman

[57] ABSTRACT

A color electrographic apparatus is provided including a latent image forming device for forming plural electrostatic latent images respectively corresponding to image signals of different colors on the surface of a photoconductor, a plurality of toners of different colors each of which has the same polarity as the photoconductor, and a plurality of developing devices which are disposed in the vicinity of the photoconductor and each of which contain a colored toner for respectively developing the latest image without contact with the photoconductor under a direct electric field. A toner image is formed by a repeating cycle of making electric charges on the surface of the photoconductor, activating the latent image forming device so as to light expose an image corresponding to respective image signals of different colors on the surface of the photoconductor and activating a respective developing device so as to develop the exposed image by a respective toner corresponding to the image signal. Even further, a reversal flying preventing device is provided for preventing reversal flying of toner of the image from the photoconductor to one of the developing devices which is not developing as the image passes before the developing device.

7 Claims, 11 Drawing Sheets

COLOR ELECTROPHOTOGRAPHIC APPARATUS AND METHOD

FIELD OF THE INVENTION AND RELATED ART STATEMENT

1. Field of the Invention

The present invention relates to a color electrophotographic apparatus which is to be used for a color copier, a color printer or the like, and especially relates to a onetime transfer type color electrophotographic apparatus in which a color picture is made by transferring a composite color image consisting of plural different color toner images at onetime.

2. Description of the Related Art

In a onetime transfer type color electrophotographic apparatus, plural different color toner images are formed on a photoconductor by repetition of electric chargings, light exposures of image and developings, to make a composite color toner image, and a color picture is obtained by transferring such composite color toner image at onetime.

A conventional onetime transfer type color electrophotographic apparatus, for example that shown in Japanese published unexamined patent application Sho 60-95456 is described with reference to FIG. 1, FIG. 2, FIG. 3, FIG. 4 and FIG. 5.

FIG. 1 is a schematic cross-sectional side view of the conventional color electrophotographic apparatus using a conventional process. The conventional color electrophotographic apparatus comprises a photoconductor 1 which is made of selenium-tellurium (Se-Te) and rotates in clockwise direction, a corona charger 2 which electrically charges the photoconductor 1, a laser beam scanner 3, developing units 4, 5, 6 and 7 which respectively contain yellow, magenta, cyan and black toners, an image receptive paper 8, an eraser lamp 9, a corona transfer 10, a heating fuser 11, a cleaning blade 12 and another eraser lamp 13 for resetting a surface potential of the photoconductor 1 in the previous state.

FIG. 2 shows the constitution of the developer 4, 5, 6 or 7. The developer comprises a two-components developer 14 (hereinafter abbreviated as the developer) which contains a mixture of a positive charged toner 20 and a magnetic carrier, a toner carrier 15 which is made of aluminum, a magnet roller 16, a layer thickness control blade 17 for controlling the layer thickness of the developer, a scraper 18, a rotary fin 19 for stirring up the developer 14, a toner supplying roller 21 and an electric power source 22 for making a potential which is made by superposing a high voltage alternating potential over a D.C. potential. In order to set up the developers in a developable state, the toner carrier 15 is connected to the electric power source 22. And in order to set up the developers in an nondevelopable state, the toner carrier 15 is electrically floated or grounded, or is applied with a negative D.C. potential.

Method for making a color picture by using the above-mentioned conventional apparatus is described as follows. First, a negative latent image for yellow toner of electrostatic charge (in which the surface potential of the photoconductor is decreased along the line-image by the image exposure) is formed by scanning of light exposure of image signals of yellow component by the laser scanner 3 after the positive electric charge of the photoconductor 1 by the corona charger 2. And a toner image of yellow is formed on the photoconductor 1 by reversal development of the electrostatic latent image from negative to positive by the developing unit 4 which contains the yellow toner. In such case, only the developing unit 4 which contains the yellow toner is connected to the electric power source 22, and other developing units 5, 6 and 7 are adjusted to a nondeveloping state which is to be described later. After development by the yellow toner, the electrostatic latent image of yellow is erased by irradiating the whole parts of photoconductor 1 by the eraser lamp 13.

By repeating the similar processes of electric charge, image exposure, developing and photo-erasing of electric charge to that of the above-mentioned yellow toner image forming method, toner images of yellow, magenta, cyan and black are formed on the photoconductor 1. After finishing the forming of all the toner images of four colors, the electrostatic latent images are erased by the eraser lamp 9, and the toner images are electrostatically transferred on a plain paper 8 by the corona charger 2. The toner images transferred on the plain paper 8 is fixed by application of heat from heating of the heating fuser 11. After electrostatically transferring the toner images, the remained toners on the photoconductor 1 are cleaned up by the cleaning blade 12, so that the photoconductor 1 prepares for next image forming.

The above-mentioned conventional apparatus has, however, problems that the developing units are gradually contaminated by different color toners in proportion to number of copy times, and the color purity of the color picture also gradually decreases. In investigating the cause of such phenomena, it is found that a part of toners of a color toner image on the photoconductor 1, on which another image corresponding to another color is exposed after re-charging of the surface of the photoconductor 1, flies reversely to the toner carrier of the developing unit, when the toner image passes through the developing unit which is not involved to the development.

FIG. 3, FIG. 4 and FIG. 5 schematically show the above-mentioned toner behaviors.

FIG. 3 shows the case that the toner carrier 15 is grounded. The regions A and C on the surface of the photoconductor 1 are electrically charged in positive. And the toners on the photoconductor 1 are also charged in positive. Accordingly, the toner 23 on the region C fly reversely to the toner carrier 16, by an electric repulsion force of the positive electric charge on the photoconductor 1 induced by an electric field generated between the photoconductor 1 and the toner carrier 15.

FIG. 4 shows the case that the toner carrier 15 is applied with a negative D.C. potential. In such case, the positively charged toners 24 on the toner carrier 15 are electrostatically attached strongly to the toner carrier 15 which is applied with a negative potential, so that it is very effective to prevent the flying of toners from the toner carrier 15 to the photoconductor 1. But the intensity of the electric field on the region C between the photoconductor 1 and the toner carrier 15 is larger than that in the case shown in FIG. 3. Accordingly, the toners 25 on the region C fly more than that in the case shown in FIG. 3. Furthermore, when the value of the D.C. potential which is applied to the toner carrier 15 becomes larger, the toners 25 on the region D also fly reversely.

FIG. 5 shows the case that the toner carrier 15 is electrically floated. As shown in FIG. 5, the toner carrier 15 is polarized by the positive electric charges on the photoconductor 1. Accordingly, a part of toners 24, namely that on the region B of the toner carrier 15 fly to the photoconductor 1. And a part of toners 26 on the region C of the photoconductor 1 fly reversely to the toner carrier 15.

As mentioned above, in the conventional color electrophotographic apparatus, a part of toners of a color toner image on the photoconductor 1, on which another images corresponding to another color is exposed on after re-charging the photoconductor 1, fly reversely to a toner carrier of a developing unit, when the toner image on the photoconductor passes through the developing unit which is not in relation to the development. Accordingly it is impossible to prevent the contamination of the developing unit caused by the mixing of toners of different colors and to obtain clear color copies stably.

OBJECT AND SUMMARY OF THE INVENTION

Purpose of the present invention is to provide a color electrophotographic apparatus by which clear color copies can be obtained stably without contamination of the developing means by mixing of the different color toners.

A color electrophotographic apparatus in accordance with the present invention comprises, latent image forming means for forming plural electrostatic latent images respectively corresponding to image signals of different colors on a surface of a photoconductor, plural developing means which are disposed in the vicinity of the photoconductor and respectively contain different color toners corresponding to the different color image signals, toner image forming means for forming plural toner images of different colors on the surface of the photoconductor, by making electric chargings on the surface of photoconductor, light exposuring images corresponding to respective image signals of the different colors on the surface of the photoconductor and developing the exposed image by respective toners corresponding to the image signal, and reversal flying preventing means for preventing reversal flying of toner of image from the photoconductor to at least one of the developing means which is not making the development of the toner image during while the toner image passes before the developing means.

DESCRIPTION OF THE PREFERRED EMBODIMENTS

As a photoconductor which is used in the present invention, an ordinary electrophotographic photoconductor in which photo-conductive materials such as amorphous selenium, arsenic selenide, CdS, ZnO, amorphous silicon or organic photo-conductive material are coated on an electric conductive material, can be used.

Figure 1:
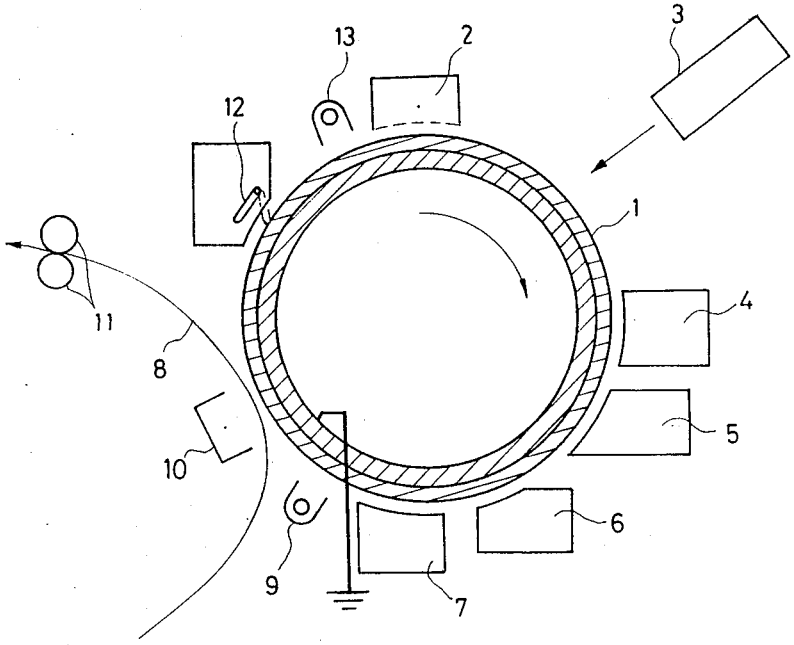
FIG.1 (Prior Art)
FIG. 1 is the schematical cross-sectional side view of the conventional color electrophotographic apparatus.
Figure 2:
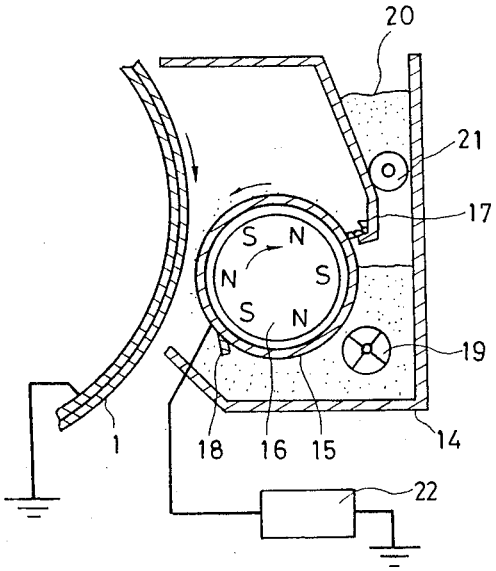
FIG.2 (Prior Art)
FIG. 2 is the cross-sectional side view of the developer of the conventional color electrophotographic apparatus.
Figure 3:
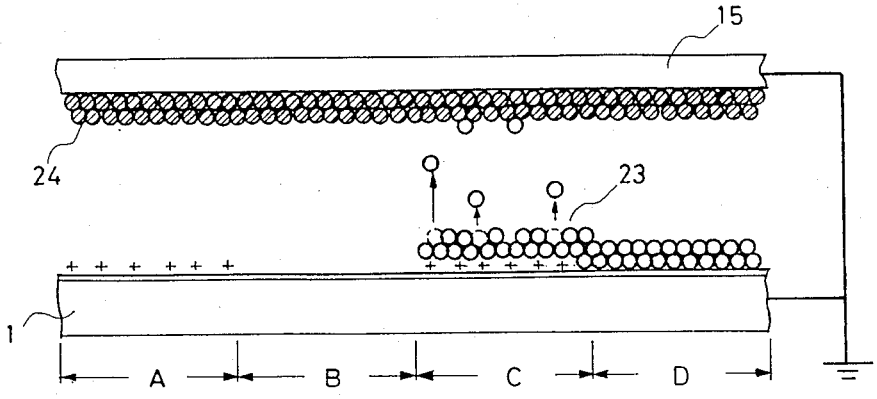
FIG. 3 (Prior Art)
FIG. 3 is the typical side view which shows the behavior of the toners in case that the toner carrier is electrically grounded.
Figure 4:
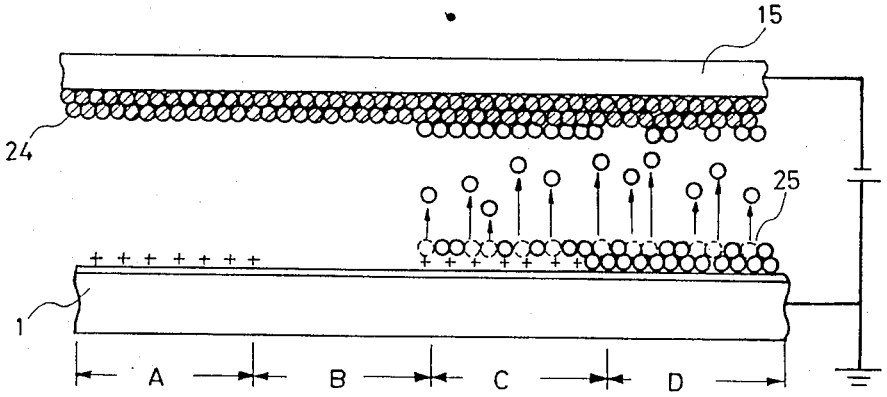
FIG. 4 (Prior Art)
FIG. 4 is the typical side view which shows the behavior of the toners in case that the toner carrier is applied with the D.C. potential.
Figure 5:
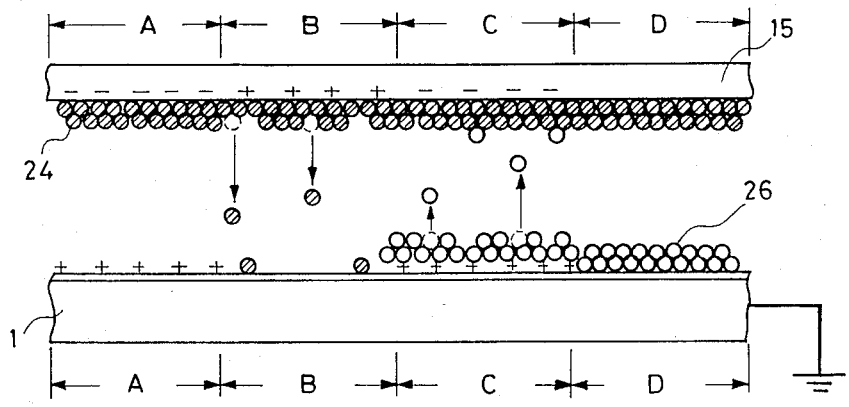
FIG. 5 (Prior Art)
FIG. 5 is the typical side view which shows the bahavior of the toners in case that the toner carrier is electrically floated.
Figure 6:
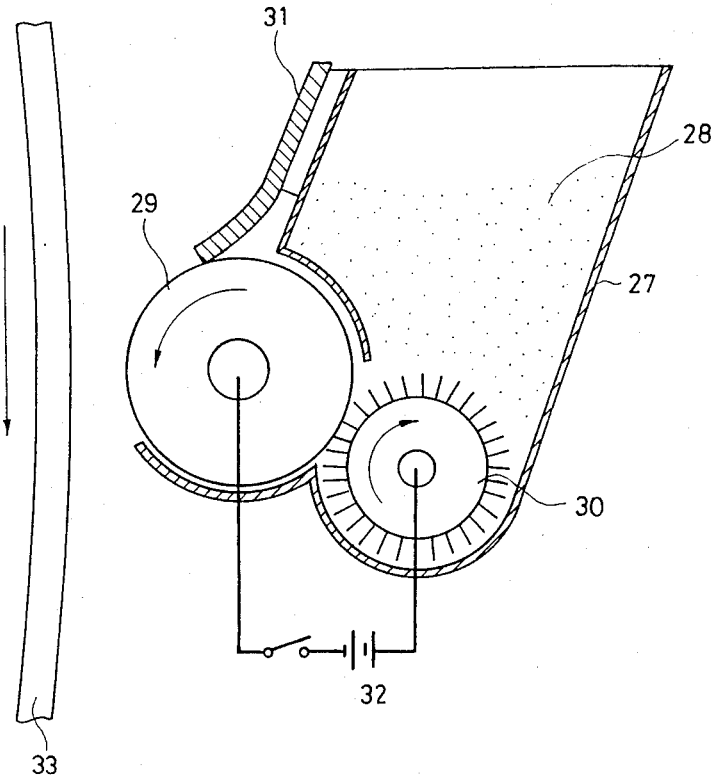
FIG. 6 is a cross-sectional side view of a developer of a color electrophotographic apparatus in according with the present invention.

As a developing means used in the present invention, any non-contact developing method, which has an effect of counter electrode to a photoconductor and develops without contacting any element of the developing unit and the photoconductor, can be adopted. For example, there is an electric field flying type developing method wherein a toner carrier, which holds a thin film of toners formed on a thereon, is disposed without directly contacting the toners on the photoconductor, and the toners on the toner carrier are flown by the action of electric field which is applied between the toner carrier and the photoconductor. And especially, a D.C. electric field flying type developing method is suitable because in such method the toners are flown in one way direction. FIG. 6 shows a preferred embodiment of a developing device which is used in the D.C. electric field flying type developing method using a non-magnetic single component developer.

The developing unit comprises a toner particles container 27, containing non-magnetic toner 28, a toner carrier 29 which is made of a metal cylinder such as aluminium or stainless steel, a fur brush roller 30 which is made of electrically conductive material such as resin fiber containing carbon or metal wire, a rubber blade 31 and a D.C. power source 32. The toner carrier 29 faces to a photoconductor 33 with a fixed gap in order to develop the latent image on the photoconductor 33. Then, the gap is adjusted not to contact the toners on the toner carrier 29 with the photoconductor 33. The gap between the toner carrier 29 and the photoconductor 33 is preferably within a range of 500 $\mu$m and especially suitable to be in a range of 50–300 $\mu$m.

In order to form a thin film layer of the toner on the surface of the toner carrier 29, the toner carrier 29 and the fur brush roller 30 are rotated in respective directions marked by arrows in FIG. 6, the toner particles 28 are charged by rubbing and electrostatically sticked to the toner carrier 29. Then, a D.C. potential can be applied between the toner carrier 29 and the fur brush roller 30 in such direction that the toner particles 28 are electrostatically attached to the toner carrier 29, or the fur brush roller 30 can be electrically floated or grounded. And the thin film of the toner is formed by leveling the electrostatically sticked toner particles 28 on the toner carrier 29 by the rubber blade 31.

On the other hand, in order to remove the toner particles 28 on the toner carrier 29, a D.C. potential is applied between the toner carrier 29 and the fur brush roller 30, so that the toner particles 28 are electrostatically attached to the fur brush roller 30. For example, in case that the toner particles 28 are positively charged, the fur brush roller 30 only needs to be applied with the negative potential.

As a toner used in the present invention, any insulative toner which is usable in conventional electrophotographic apparatus can be used irrespective of the magnetic or non-magnetic of its characteristics. In color recording, the non-magnetic toner is especially suitable because it is superior in the transparency. As a toner for electric field flying type developing method, the toner of electric charge of 0.1–10 μC/g, more preferably 1–6 μC/g, is suitable.

As a light source used in the present invention, any of normal light source such as a light emitting diode array, a semi-conductor laser, a combination of a liquid crystal switching device and a light source or a halogen lamp, can be used.

FIG. 7, FIG. 8, FIG. 9, FIG. 10, FIG. 11, FIG. 12, FIG. 13, FIG. 14 and FIG. 15 show the principle of a color electrophotographic apparatus in accordance with the present invention. Hereupon, for the convenience of the explanation, the reversal developing from negative to positive is described.

Figure 7:
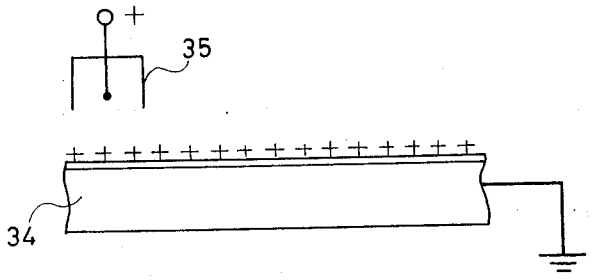
FIG. 7, FIG. 8, FIG. 9, FIG. 10, FIG. 11, FIG. 12, FIG. 13, and FIG. 14 are typical side views showing principles of a color electrophotographic apparatus in accordance with the present invention.
Figure 8:
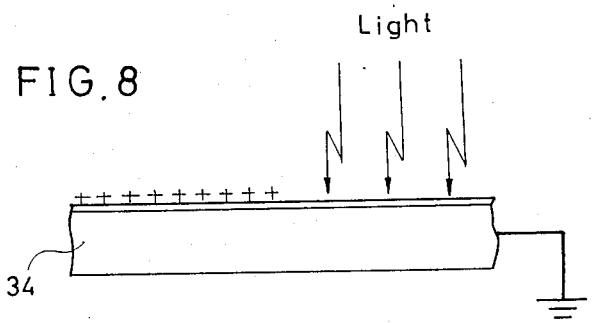
Figure 9:
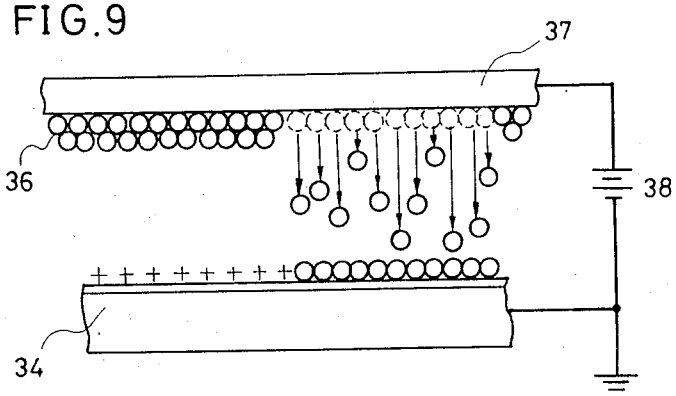

FIG. 7 shows the positive electric charge of a photoconductor 34 made by a corona charger 35. FIG. 8 shows a process for forming a first negative electrostatic latent image on the photoconductor 34 by light exposure of a first image. Hereupon, the potential corresponding to the contrast of the electrostatic latent image (which is the difference between the potentials of image part and non-image part) is suitable to be over 400 V. FIG. 9 shows the process for forming a first toner image which contains a step of facing a first toner carrier 37 bearing a positively charged from toner particles 36 to the photoconductor 34 without contacting the toner particles 36 with the photoconductor 34, and another step of reversal developing of the first electrostatic latent image by the flying of the toner particles 36 from the toner carrier 37 to the photoconductor 34, by appication of a D.C. potential which is nearly equal to the potential of non-image part of the latent image on the toner carrier 37.

Figure 10:
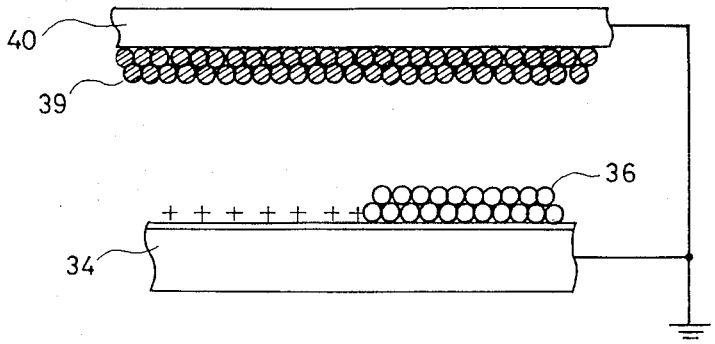

FIG. 10 shows a state that a second toner carrier 40 is electrically grounded when the photoconductor 34 holding the first toner particles image of the first toner 36 passes before the second toner carrier 40 which bears a second toner particles 39 and does not serve in the developing of the first image. In this case, since the potentials of the toner carrier 40 and a part of the photoconductor 34 where the toner particles 36 are sticked are hardly different from each other, the reversal flying of the toner particles 36 from the photoconductor 34 to the toner carrier 40 may not occur. Hereupon, the toner carrier which is not involved in the development may be set in a state shown in FIG. 13, which is to be described afterward.

Figure 11:
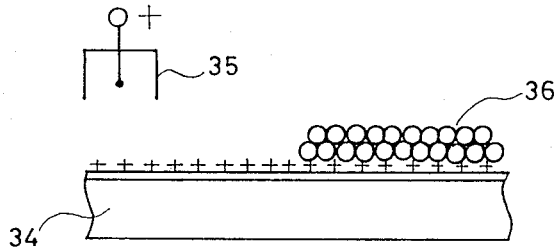
Figure 12:
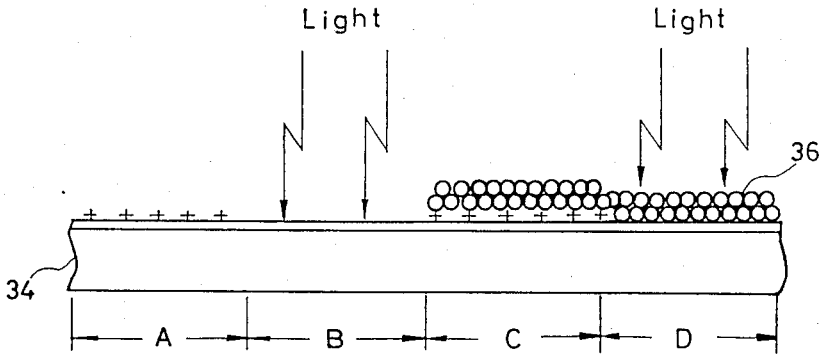

FIG. 11 shows positive re-charging of the photoconductor 34 bearing the first toner particles 36 by the corona charger 28. FIG. 12 shows a process of forming a second negative electrostatic latent image by light exposure of a second image. And the photoconductor 34 passes through another developing unit which does not serve in the development. Then, it is important to prevent the reversal flying of the toner particles 36 on the photoconductor 34 to a developing unit which is not in relation to the development.

Figure 13:
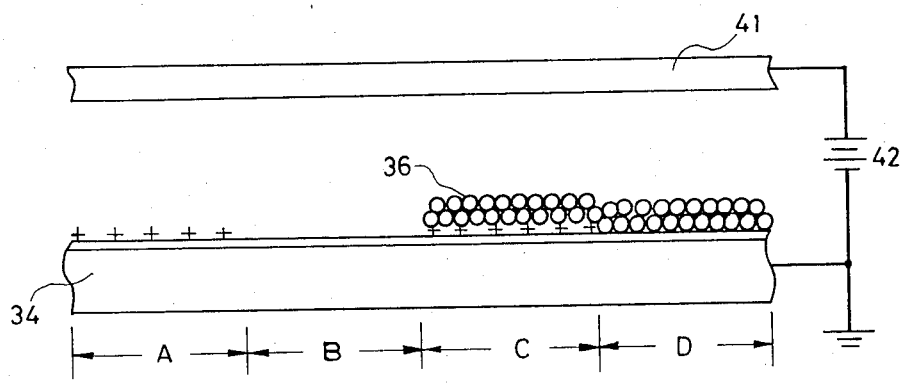

FIG. 13 shows a means for preventing the reversal flying of the toner particles on the photoconductor. In FIG. 13, toner particles on a toner carrier 41 which does not serve in the development is previously erased, and a D.C. potential 42 which is nearly equal to the potential of the non-image part of the photoconductor 34 (regions A and C) is applied to the toner particles carrier 41. Hereupon, the toner 36 on the regions of the photoconductor 34 remain as they are without reversal flying because the potentials of the image part of the photoconductor 34 (regions B and D) and of the toner carrier 41 are hardly different from each other. In this case, in order to erase the toner particles on the toner carrier 41, a D.C. potential is applied between the toner carrier 41 and a fur brush roller (which is not shown in the figure), so as to electrostatically remove the toner to the fur brush roller, in the similar manner to the method described in FIG. 6.

Figure 14:
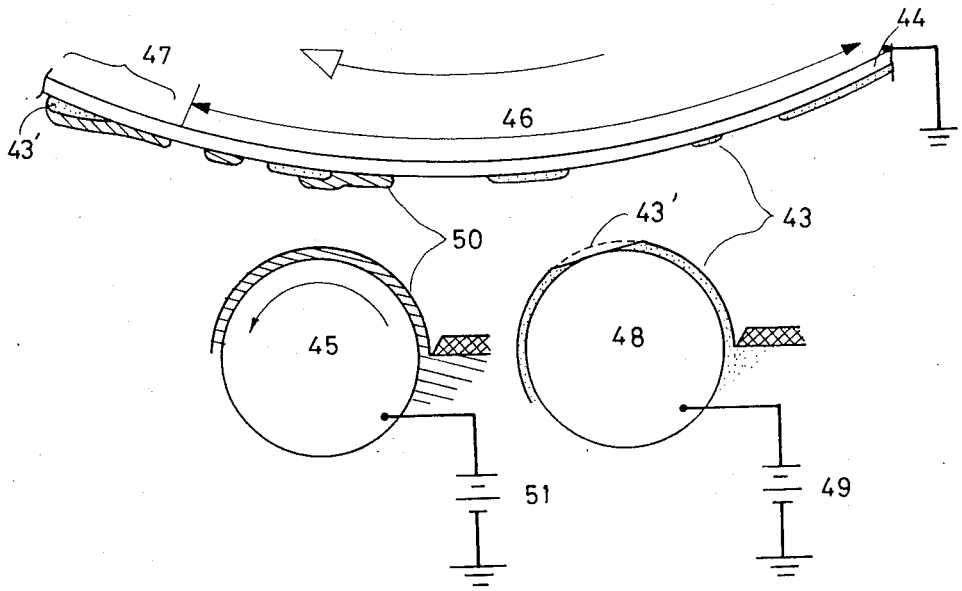

FIG. 14 shows another means for prevent the reversal flying of the toner particles on the photoconductor. After re-charging a photoconductor 44 which bears a toner particles 43, developed region 47 is formed prior to forming of an image region 46, when a second electrostatic latent image is formed. And when an image part of the photoconductor 44 passes before a toner carrier 48 which does not serve in the developing, the rotation of toner carrier 48 is stopped and a D.C. potential 49 is applied which is nearly equal to the potential of the non-image part of the photoconductor 44. As a result, toner particles 43 which face to the photoconductor 44 fly to the developed region 47, and the toner particles 43' on the toner particles carrier 48 are removed. Accordingly, the image on the line image part 46 are not developed by the toner particles 43', and the toner particles 43 on the photoconductor 44 do not reversely fly, because the potentials of the part without line image on the image part 46 and of the toner carrier 48 are hardly different from each other.

Figure 15:
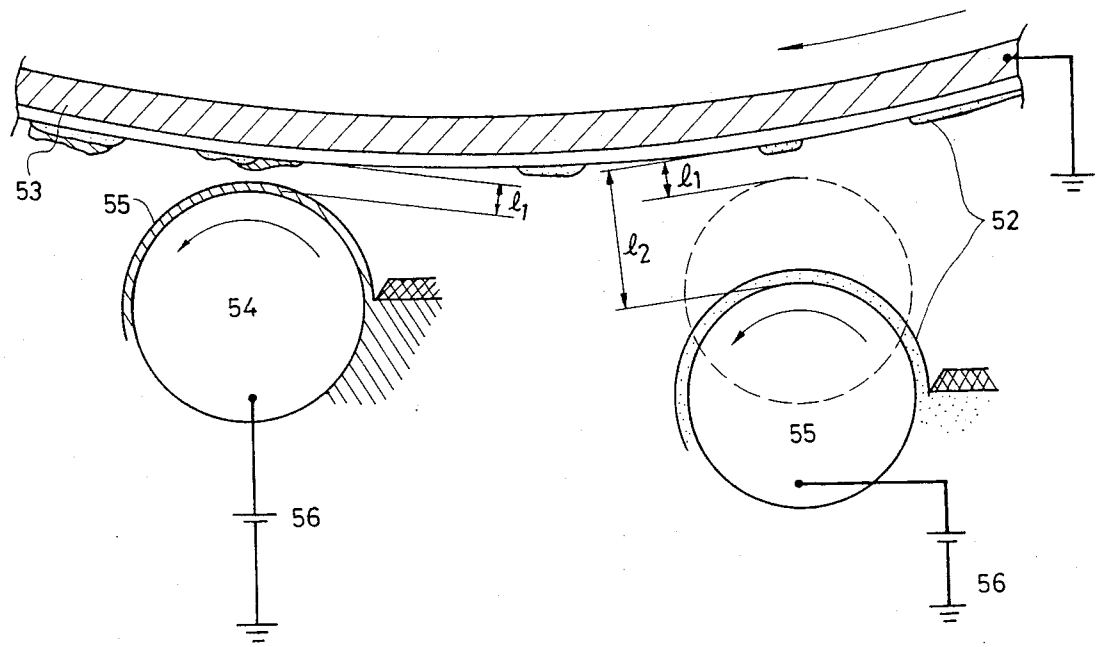
FIG. 15 is a cross-sectional side view showing an embodiment of a color electrophotographic apparatus in accordance with the present invention which is applied to a color printer.

FIG. 15 shows still other means for preventing the reversal flying of the toner particles on the photoconductor. In case that the second electrostatic latent image formed by re-charging and light exposure of the image on a photoconductor 53 holding toner particles 52 is developed by toner particles on a toner carrier 54 (hereupon the gap $l_1$ between the photoconductor 53 and the toner carrier 54 is 50–300 μm), a toner carrier 55 is displaced from the photoconductor 53 so as to widen a gap between the photoconductor 53 and the toner carrier 55 over 500 μm, more preferably 700 μm, applying a D.C. potential 56 which is need to develop, when an image part of the photoconductor 53 passes before the toner carrier 55. Since the threshold gap which permits the toner on the toner particles carrier to fly to the photoconductor is 500 μm, as is described in the explanation of FIG. 6, the toner carrier 55 which is now wider than the threshold gap does not develop the second electrostatic latent image. And also, since the intensity of the electric field between the photoconductor 53 and the toner particles carrier 55 becomes small, the toner 52 on the photoconductor 53 may not reversely fly to the toner carrier 55. Hereupon, it is preferable to rotate the toner carrier 55 whether or not it is to be involved in the developing. If the toner carrier 55 has stopped its rotation, the charge of the toner particles on the surface of the toner carrier 55 becomes insufficient at use in the next development and the picture image may be badly affected.

Figure 16:
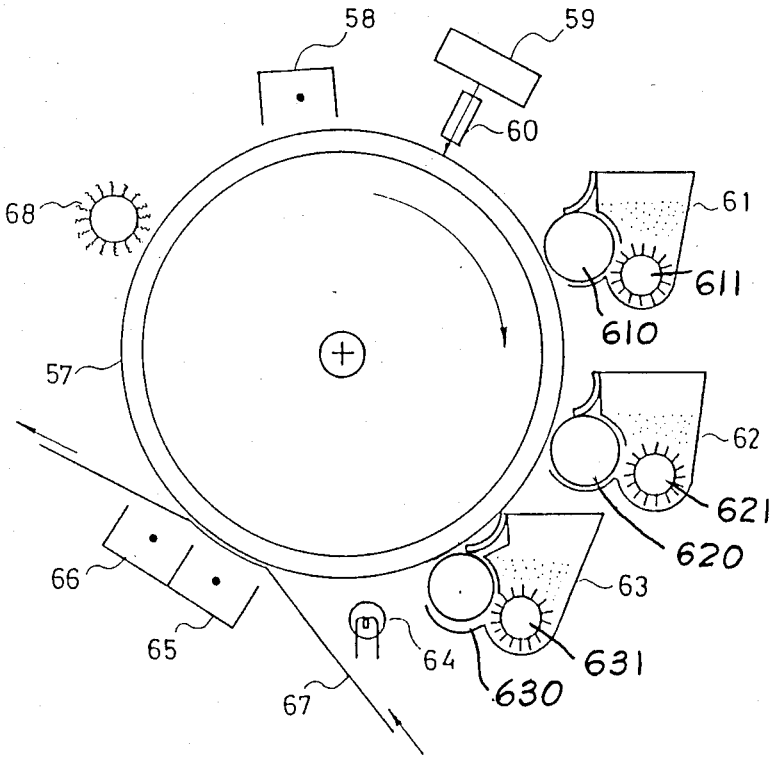
FIG. 16 is a cross-sectional side view showing another embodiment of a color electrophotographic apparatus in accordance with the present invention.

FIG. 16 schematically shows a color printer using a color electrophotographic apparatus in accordance with the present invention.

The color printer comprises a photoconductor 57 which is made of vapor coated selenium-tellurium over aluminium drum, a corona charger 58, a light emitting diode array 59 for emitting a light of wave length of 670 nm, a self-focusing rod lens array 60, developing units 61, 62 and 63 which respectively contain yellow, magenta and cyanic colored toners, their constitutions being the same as the developing device shown in FIG. 6, an eraser lamp 64, a corona charger 65 for transferring, an AC detach charger 66 for peeling off a plain paper 67 and a cleaning brush 68.

Details of the developing devices 61, 62 and 63 are described in the followings. As the toner carriers, aluminium cylinders were used. As the fur brush rollers, carbon-containing rayon fiber of resistance of $10^6$ Ωcm, which was planted on an aluminium drum, was used. As the yellow, magenta and cyan toners, non-magnetic toners, wherein main components were resin and pigment, were used. Hereupon, average diameter of toner particles was 10 μm, quantities of electric charge were 2–4 μC/g and electric resistances were respectively over $10^{-}$Ωcm.

Next, a method for making a color picture is described as follows. The photoconductor 57 was charged to +800 V by the corona charger 58 (therein, the corona potential was 7 kV) being rotated in the arrow-marked direction. A electrostatic latent image of the yellow, in which the potential of the non-image part was +800 V and the potential of the image part was +80 V, was formed by scanning exposure of image signals of yellow by the light emitting diode array 59. After that, the electrostatic latent image was developed by yellow color toner during the passing of photoconductor 57 before the three developing units 61, 62 and 63.

The conditions of each developing units in the above-mentioned case are described as follows. The toner carrier and the fur brush roller of the developing unit 61 for yellow were respectively applied with +750 V and +1000 V of D.C. potential. Then, the thin layer of yellow color toner (about 40 μm) was formed on a toner carrier 610 of the developing unit 61, the yellow color toner flew from the toner carrier 610 to the photoconductor 57 at part of the most proximation point, and the electrostatic latent image on the photoconductor 57 was developed by the yellow color toner.

On the other hand, when the toner carriers of 620 and 630 of the developing units 62 and 63 of magenta and cyan, respectively, were gronded, there were no fog of resultant picture of magenta color toner or cyan color toner at all.

After such developing, the photoconductor 57 bearing the yellow toner image was irradiated by the eraser lamp 64, and the electrostatic latent image was photoelectrically erased. After that, the photoconductor 57 was electrically re-charged over the toner image by the corona charger 58 (the corona potential was +7 kV). The surface potential of the photoconductor 57 was +800 V irrespective of the existence or non-existence of the toner.

Next, an electrostatic latent image of the magenta in which the surface potential of the non-image part was +800 V and the surface potential of the image part not over the yellow toner was +80 V and the potential over yellow toner was +110 V, was formed by the scanning exposure of image signal in accordance with magenta by the light emitting diode array 59. After such exposure, the electrostatic latent image was reversally developed by magenta color toner, during the passing of photoconductor 57 before the three developing devices 61, 62 and 63 under the following condition.

When the D.C. potential of +750 V was applied on the toner carriers 610 and 630 and the D.C. potential of +550 V was applied to the fur brush rollers 611 and 631 of the developing units 61 and 63 which contain the yellow and cyan color toners, the toners on the toner carriers 610 and 630 were removed. And also the toner carrier 620 of the developing unit 62 of the magenta was applied with the D.C. potential of +750 V and the fur brush 621 was applied with the D.C. potential of +850 V. As a result, a toner image composed of the yellow color toner and magenta color toner was formed on the surface of the photoconductor 57. The reversal flying of the yellow color toner on the photoconductor 57 to the developing units 61 and 63 was not observed.

The photoconductor 57 developed by the magenta color toner was erased and re-charged by the same method of forming the magenta color toner image, and the image signal of cyan image was scanningly exposed by the light emitting diode array 59. The surface potential of non-image part of the photoconductor 57 was +800 V regardless of the existence or non-existence of the toner, and the surface potential of the image part where only the yellow color toner or the magenta color toner was attached was +110 V and that were the yellow color toner and the magenta color toner were overlapped was +120 V.

Next, the electrostatic latent image on the photoconductor 57 was reversally developed by the cyan color toner during the passing of photoconductor 57 before the developing units 61, 62 and 63, under the condition that the toner carriers of the developing units 61 and 62 which contained yellow and magenta color toners were applied with the D.C. potential of +750 V. The fur brushes of the developing units 61 and 62 were applied with the D.C. potential of +550 V, the toner carrier 630 of the developing unit 63 which contained the cyan color toner was applied with the D.C. potential of +750 V and the fur brush 631 of the developing device 63 was applied with the D.C. potential of +850 V.

After that, whole part of the photoconductor 57 was irradiated by the eraser lamp 64, the toner image on the photoconductor 57 was transferred onto the plain paper 67 by the corona charger 65 (wherein the corona potential was −5.5 kV), and the plain paper 67 was peeled off from the photoconductor by the AC detach charger 66. The toner image transferred to the plain paper 67 was heated and fixed on the plain paper 67 by the heating fuser. After such transfer of the toner image, the toner remaining on the photoconductor 57 was cleaned up by the cleaning brush 68, and the photoconductor 57 was used for next image forming.

Examination of the contamination of each developing units by the different colored toners was made after repeating the above-mentioned process 1000 times. It is revealed that any of different colored toner was not confirmed in the examination with naked eyes. And also a comparison of the color copies made at the first time and at the 1000th times, both of them were clear enough and no difference of the picture qualities was distinguishable.

Figure 17:
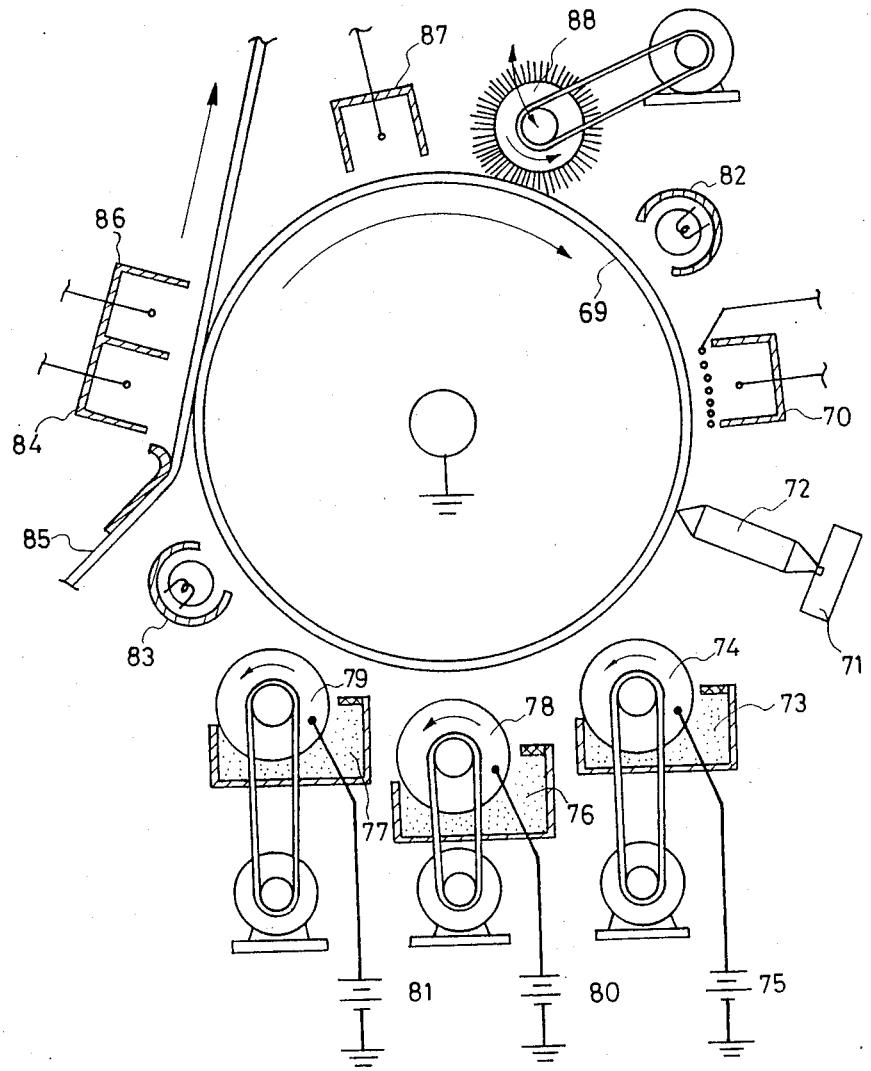
FIG. 17 is a cross-sectional side view showing still other embodiment of a color electrophotographic apparatus in accordance with the present invention.

FIG. 17 schematically shows a color printer used in another embodiment of the present invention.

This embodiment is especially of such type of color printer having three toner carriers 74, 78 and 79 which are freely controlled of the rotation such as to rotate when they serve in the development or to stop when they are not involved in the development.

The surface potential of the photoconductor 69, which is made of amorphous selenium-tellurium formed on a cylindrical drum of 100 mm diameter and is rotated at a peripheral speed of 75 mm/s, was charged to +800 V by the corona charged 70 (wherein, the corona potential was +7 kV and the grid potential was +850 V). Then, the light emitting diode 71, wherein output power was 7 μW and the wave length of the emitted light was 670 nm, was emitted. The emitted light exposed the photoconductor 69 by passing before the rod lens array 72, and a solid area which was to be developed and not involved in the image forming, was formed on the surface of the photoconductor 69 of 10 mm width against the rotational direction. After that, the light signal corresponding to the yellow signal was exposed on and the electrostatic latent image was formed on the surface of the photoconductor 69.

The electrostatic latent image was developed by the yellow colored toner by passing before the toner carrier 74 (the diameter was 16 mm; peripheral speed was 75 mm/s; thickness of toner layer was 30 μm; and developing gap to the photoconductor was 150 μm), bearing the yellow color toner particles 73 (charge quantity of the toner was +3 μC/g, average diameter of the particle was 10 μm). Then the toner carrier 74 was applied with the D.C. potential 75 of +700 V. The thickness of the toner layer attached on the photoconductor 69 was about 10 μm.

The yellow color toner image on the photoconductor 69 was passed before the toner carriers 78 and 79 which respectively contained the magenta color toner particles 76 and the cyan color toner 77 and were stopped the rotation. Then the toner carriers 78 and 79 were respectively applied with the D.C. potentials 80 and 81 of +850 V. As the toner on the toner particles carriers 78 and 79 which contain the magenta and cyan color toners were previously erased by the solid area on the photoconductor 69, the electrostatic latent image was not developed by the magenta color toner or the cyan color toner.

After wholly erasing the electric charge on the photoconductor 69 by the eraser lamp 82, the surface of the photoconductor 69 was re-charged by the corona charger 70. Regardless of the existance of the yellow color toner or not, the photoconductor 69 was charged to +800 V. Then, in the surface potentials of the photoconductor 69 on which the yellow color toner was attached, the potential of the toner was about +50 V and that of the photoconductor itself was about +750 V.

After forming a solid area of electrostatic latent image part (of 10 mm width) was formed on the photoconductor 69 again by the light emitting diode 71, the light corresponding to the magenta image signal was emitted on the surface of the photoconductor 69. The surface potential of a part where the yellow color toner was attached was decreased to about +80 V.

After that, the photoconductor 69 bearing the electrostatic latent image corresponding to the magenta was passed before the toner carrier 74 containing the yellow colored toner particles. Hereupon, the toner carrier 74 was kept from rotating under application of the D.C. potential of +850 V. Accordingly, the yellow colored toner particles 73 on the toner carrier 74 was previously removed by the solid area of electrostatic latent image part. Therefore, the reversal flying of the toner from the non-image part of the photoconductor 69 where the yellow colored toner particles were attached to the toner carrier 74 does not occur and the electrostatic latent image of magenta was not developed by the yellow colored toner particles 73. Furthermore, the electrostatic latent image was developed by the magenta colored toner particles 76 when the photoconductor 69 was passed before the toner carrier 78 (wherein diameter was 16 mm, the peripheral speed was 75 mm/s, the thickness of the toner layer was 30 μm and the gap to the photoconductor was 150 μm) which held the magenta colored toner particles 76 applied with the D.C. potential of +700 V (the charge quantity of the toner was +3 μC/g and the average diameter of the particle was 10 μm). And the photoconductor 69 was passed before the toner carrier 79. When the D.C. potential of +850 V was applied to the toner carrier 79 stopping the rotation, the cyan colored toner particles 77 on a part of the toner carrier 79 facing to the photoconductor 69 was previously erased by the solid area of electrostatic latent image. Therefore, the electrostatic latent image of magenta was not developed by the cyan colored toner particles 77.

Furthermore, after re-charging the photoconductor 69 as the potential of +800 V by the corona charger 70 and forming the solid area of electrostatic latent image (width was 10 mm) on the photoconductor 69 by the light emitting diode 71, the electrostatic latent image of cyan was formed on the photoconductor 69 by emitting the light signal corresponding to the cyan image. The electrostatic latent image was developed by the cyan colored toner particles 77 when the photoconductor 69 was passed before the toner carrier 79 (wherein diameter was 16 mm, the peripheral speed was 75 mm/s, the thickness of the toner layer was 30 μm and the gap to the photoconductor was 150 μm) which held the cyanic color toner 77 applied with the D.C. potential of +700 V (the charge quantity of the toner was +3 μC/g and the average diameter of the particle was 10 μm), applying the D.C. potential of +850 V to the yellow and magenta toner carriers 74 and 78.

The color toner image on the photoconductor 69 formed by the above-mentioned process was wholly electrically erased by an eraser lamp 83, and transferred on a paper 85 by a transfer charger 84. The paper 85 was peeled off from the photoconductor 69 by the detach charger 86, and the color toner image was fixed on the paper 85 by heating fuser. After such transferring, the photoconductor 69 was electrically erased by a erase charger 87, the remained toner on the photoconductor 69 was cleaned up by a cleaning apparatus 88, and the photoconductor 69 was used for the next image forming.

The obtained color picture was of high quality as having the maximum density was 1.7 and excluding impurity of the color. And after repetition of the above-mentioned processes 3000 times, different color toners were not mixed in a developer.

As still other embodiment of the present invention, a color copier shown in FIG. 17 was constituted in that the developing devices were movable against the photoconductor 69. A color picture was formed under the same condition as mentioned above except the movement of the developing units.

After charging the photoconductor 69 to +800 V and forming the electrostatic latent image of yellow on the photoconductor 69 by light exposure, the pghotoconductor 69 was passed before the toner carriers 74, 78 and 79. The electrostatic latent image of yellow was developed by the yellow color toner 73 under the same condition of the previously described embodiment. Then, the toner carriers 78 and 79 of magenta and cyan were applied with the D.C. potential of +700 V, they were remoted from the photoconductor 69 so as to take a distance of 700 μm while keeping its rotation. As a result, neither the magenta nor cyan colored toner was attached to the electrostatic latent image at all. And when the toner carriers 78 and 79 were remoted over 500 μm, and electrically grounded or floated, a clear yellow toner image was obtained without fogging of the different color toner.

The photoconductor 69 bearing the yellow toner image was re-charged to +800 V by the corona charger 70 after blanket exposure by the eraser lamp 82. And after forming the electrostatic latent image of magenta, the photoconductor 69 was passed before the toner carrier 74. Then, the toner carrier was applied with the D.C. potential of +700 V and remoted at 700 μm from the photoconductor 69 while keeping its rotation. And a magenta toner image was obtained by developing of the photoconductor 69 by the toner carrier 78 of magenta (developing gap was 150 μm and applied potential was +700 V). Furthermore the photoconductor 69 was passed before the toner carrier 79 of cyan (gap distance to the photoconductor was 700 μm and applied potential was +700 V).

The electrostatic latent image of cyan was formed by charging of +800 V and light exposing of the photoconductor 69 after wholly electrical erasing by the eraser lamp 83 69. The photoconductor 69 was developed by cyanic color toner 72 during the passing before the rotating toner carriers 74 and 78 of yellow and magenta (gap distance to the photoconductor was 700 μm and applied potential was +700 V) and the rotating toner carrier 79 of cyanic (gap distance was 150 μm and applied potential was +700 V).

A color picture was obtained by similar transferring and heat fixing to that of the previously described embodiment. As a result, the color picture having a maximum density of 1.7 and excluding impurity of the color was obtained. And even after repeating the above-mentioned processes 3000 times, toner(s) of the different color(s) was(were) not mixed in a color developer.

We claim:

1. A color electrophotographic apparatus comprising:

latent image forming means for forming plural electrostatic latent images respectively corresponding to image signals of different colors on a surface of a photoconductor, plural toners of different colors which have the same polarity as said photoconductor, plural developing means which are disposed in the vicinity of said photoconductor, respectively contain said toners of different colors corresponding to said different color image signals, and respectively develop said images with said toners without cotact with said photoconductor under a direct electric field, toner image forming means for forming plural toner images of different colors on the surface of said photoconductor, by a repeating cycle of making electric chargings on the surface of said photoconductor, activating said latent image forming means so as to light expose an image corresponding to respective image signals of the different colors on the surface of said photoconductor and activating a respective developing means so as to develop said exposed image by a respective toner corresponding to said image signal, and reversal flying preventing means for preventing reversal flying of toner of the image from said photoconductor to at least one of said developing means which is not developing said image while said image passes before said developing means.

2. A color electrophotographic apparatus in accordance with claim 1, wherein said reversal flying preventing means has grounding means for selectively grounding a toner carrier of said developing means.

3. A color electrophotographic apparatus in accordance with claim 1, wherein said reversal flying preventing means has potential applying means for applying such a D.C. potential on a toner carrier of said developing means as is equal to a potential of non-image part of said latent image on said photoconductor.

4. A color electrophotographic apparatus in accordance with claim 1, wherein said toner image forming means is means for reversal developing from negative to positive.

5. A color electrophotographic apparatus in accordance with claim 1, wherein a first distance $l_2$ between a toner carrier without relation to the developing and said photoconductor is larger than a second distance $l_1$ between another toner carrier with relation to the developing and said photoconductor.

6. A color electrophotographic apparatus in accordance with claim 5, wherein said first distance $l_2$ and said second distance $l_1$ are respectively set as, $l_2 > 500$ μm and $300 > l_1 > 50$ μm.

7. A method of preventing reversal flying of image toner from a photoconductor to a developing means in a color electrophotographic apparatus having latent image forming means for forming plural electrostatic latent images respectively corresponding to image signals of different colors on a surface of a photoconductor, plural toners of different colors which have the same polarity as said photoconductor, plural developing means which are disposed in the vicinity of said photoconductor, respectively contain said toners of different colors corresponding to said different color image signals, and respectively develop said images with said toners without contact with said photoconductor under a direct electric field, toner image forming means for forming plural toner images of different colors on the surface of said photoconductor, by a repeating cycle of making electric chargings on the surface of said photoconductor, activating said latent image forming means so as to light expose an image corresponding to respective image signals of the different colors on the surface of said photoconductor and activating a respective developing means so as to develop said exposed image by a respective toner corresponding to said image signal, and reversal flying preventing means for preventing reversal flying of toner of the image from said photoconductor to at least one of said developing means which is not developing said image while said image passes before said developing means, wherein said reversal flying preventing means is practiced by the following steps:

(1) forming a solid area of light exposed region preceding an image region on said photoconductor, (2) stopping action of one toner carrier of said developing means which has no relation to said development, and (3) applying a substantially equal potential to that of a non-image part of the surface of the photoconductor on said toner carrier, to remove toners on said toner carrier on the said solid area of light exposed region.

* * * * *